US005722725A

United States Patent [19]

McNaughton

[11] Patent Number: 5,722,725

[45] Date of Patent: Mar. 3, 1998

[54] LUMBAR SUPPORT

[75] Inventor: Kevin J. McNaughton, North York, Canada

[73] Assignee: Ontario Inc., North York, Canada

[21] Appl. No.: 637,965

[22] Filed: Apr. 25, 1996

[51] Int. Cl.[6] ..... A47C 7/42

[52] U.S. Cl. ..... 297/284.5; 297/284.9; 297/284.7; 297/284.3

[58] Field of Search ..... 297/284.5, 284.3, 297/284.4, 284.7, 284.8, 284.9, 284.1, 452.4, 486, DIG. 6; 5/631, 900

[56] References Cited

U.S. PATENT DOCUMENTS

| | | | |
|---|---|---|---|
| 2,060,298 | 11/1936 | Gailey | 297/284.5 X |
| 2,081,111 | 5/1937 | Manley | 297/284.9 X |
| 3,279,849 | 10/1966 | Radke et al. | 297/284.5 |
| 4,506,396 | 3/1985 | Ritchie, Jr. et al. | 5/631 |
| 5,149,173 | 9/1992 | Jay et al. | 297/284.9 |

FOREIGN PATENT DOCUMENTS

| | | | |
|---|---|---|---|
| 1173209 | 12/1969 | United Kingdom | 297/284.9 |

*Primary Examiner*—Laurie K. Cranmer
*Attorney, Agent, or Firm*—Cushman Darby & Cushman, IP Group of Pillsbury Madison & Sutro LLP

[57] ABSTRACT

A lumbar support has a pair of laterally spaced cushions with a strap extending between them. The lateral spacing of the cushions may be adjusted by varying the length of the strap. The cushions are supported on the chair back by a pair of hooks that locate the cushions vertically.

17 Claims, 2 Drawing Sheets

LUMBAR SUPPORT

The present invention relates to lumbar supports.

It is well known that one should provide a chair with a lumbar support to complement the shape of the person's back and provide additional support as required. The lumbar support also maximizes the surface contact between chair surface and the person's back. Many of these supports are intended to be inserted between the person's back and the back of the chair, providing an alternative interface with the back surface. While these types of supports do provide lumbar support by giving curvature to the back of the chair, traditionally they have also created the disadvantage of shortening the seat cushion, by pushing the person forward. As a result, there is less surface area and less support provided to the thighs. This can be detrimental to the comfort of the user of the seat, as comfort is generally proportional to surface contact.

It is also desirable that a lumbar support should have sufficient individual adjustability to be able to accommodate different trunk widths and height of necessary support, so that the needs of different users can be satisfied. This is particularly useful for people who remain seated for extended periods of time, e.g. people limited to a wheelchair for mobility.

Therefore it is an object of the present invention to provide a lumbar support in which the above disadvantages are obviated or mitigated.

In general terms, the present invention provides a lumbar support comprising a pair of laterally spaced cushions. The cushions are interconnected by a strap having an adjustable length to vary the lateral spacing between the cushions. A retaining device is provided to retain the support on an associated back surface.

Preferably the retaining device permits vertical adjustment of the contoured cushions on the seat back and as a further preference, the retaining device includes a pair of hooks that extend vertically from the cushion and about an edge of the seat back to retain the support.

An embodiment of the invention will now be described by way of example only with reference to the accompanying drawings, in which FIG. 1 is a perspective view of a seat having a lumbar support associated therewith;

Figure 1:
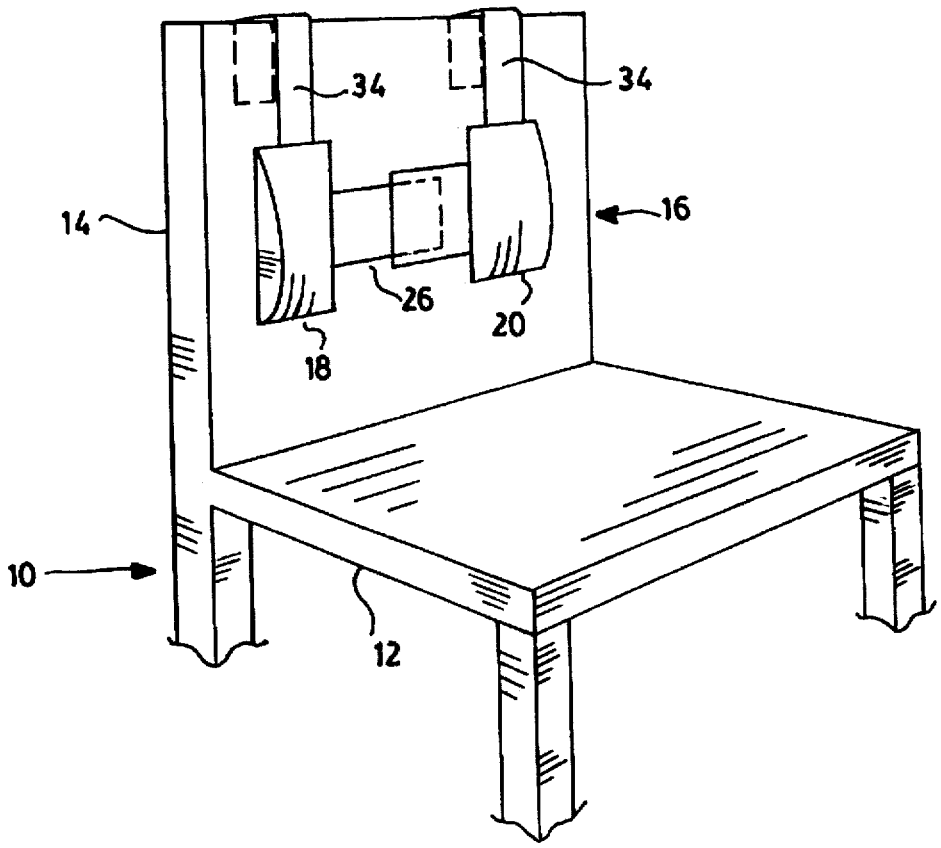
Figure 2:
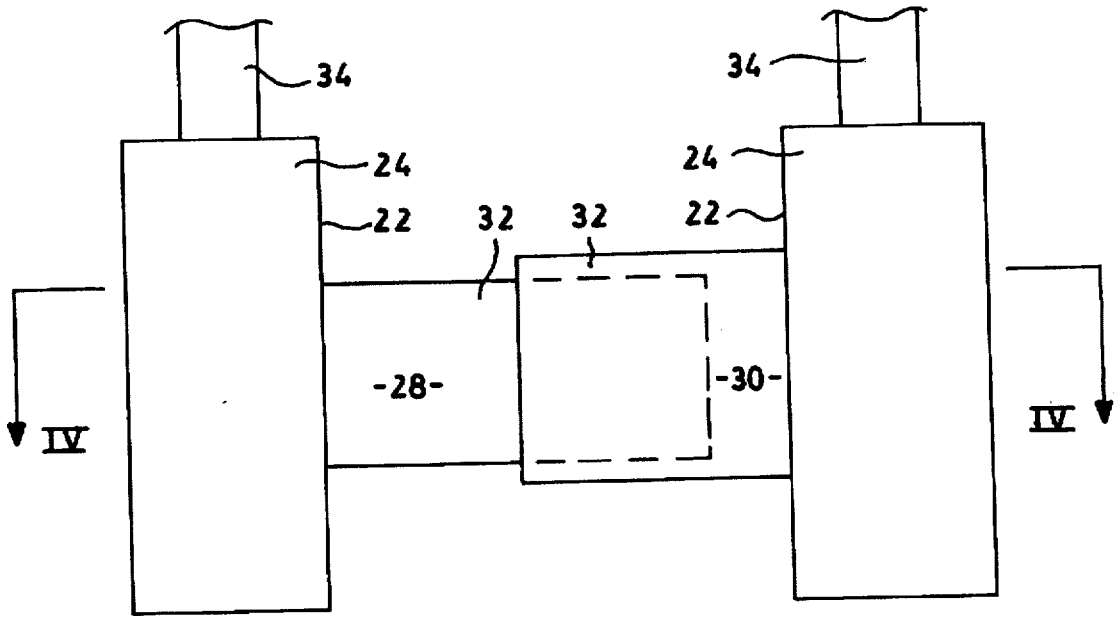
FIG. 2 is a front elevation of the support shown in FIG. 1.
Figure 3:
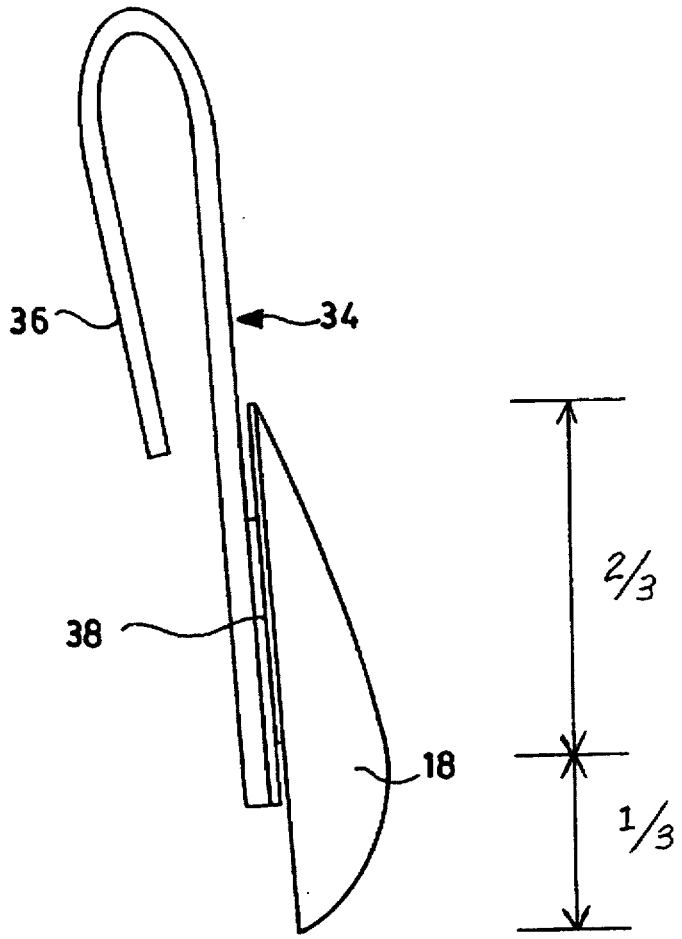
FIG. 3 is a side view of the support shown in FIG. 2.

Referring therefore to FIG. 1, a seat generally indicated 10, includes a seat cushion 12 and a seat back 14. It will be understood that the seat may be of any convenient form and may even be the seat cushion of a wheelchair. The exact form of the seat 10 is not important for a discussion of the present invention and therefore will not be described further.

Figure 4:
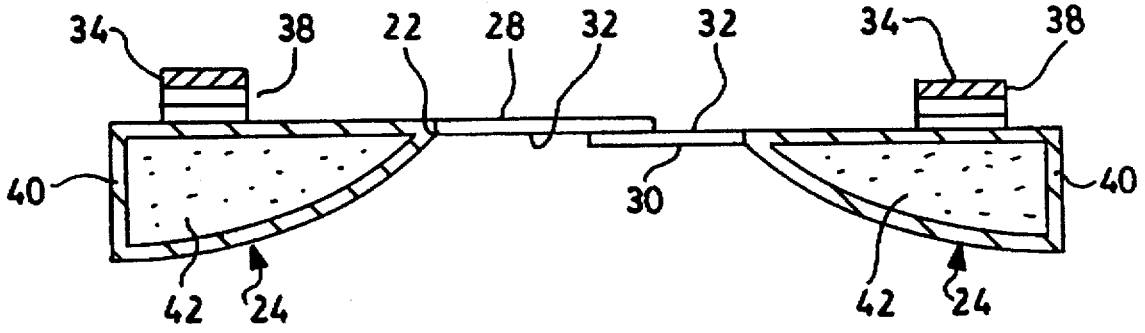
FIG. 4 is a view on the line IV—IV of FIG. 2.

A lumbar support 16 is associated with the seat back 14 and includes a pair of cushions 18,20 that are laterally spaced on the seat back 14. The cushions 18,20 are generally wedge-shaped in the transverse plane as can best be seen in FIG. 4, having a minimum thickness at the proximal or medial inward edge indicated at 22.

In the sagittal plane, inferior distal surface begins with a convex contour of the cushion, while the superior distal surface begins with a long sloping contour. The apex of the cushion is approximately at ⅓of the total mid-sagittal length. The contoured cushions are somewhat tear-drop in shape and are configured to provide support for the lumbar region.

The outwardly directed surfaces 24 of the cushion 18,20 is generally convex and progressively increase in thickness from opposite ends towards the central portion. The cushions 18,20 are configured to provide support for the lumbar region and of course may be contoured to suit individual needs and particular situations.

Typically each cushion will include a fabric outer casing 40 a resilient foam inner packing 42 suitable hard-wearing materials as is well known in the art.

The cushions 18,20 are maintained in lateral spaced relationship by a strap 26. The strap 26 is made from a pair of tongues 28,30 that extends from the laterally inner edge of the cushions 18,20 respectively. The tongues 28,30 are flexible but inextensible so that when they are secured to one another, lateral movement outwardly of the cushions 18,20 is prevented.

The tongues 28,30 are formed from two layers of the casing material so as to be relatively thin and carry a hook and loop type fastening 32 on their opposed surfaces. The hook and loop type fastening is that conventionally known under the trademark VELCRO and allows the overlapping portions of the straps 28,30 to be releasably secured to one another.

The cushions 18,20 are retained on the seat back 14 by a retaining device in the form of a pair of hooks 34. Each of the hooks is associated with a respective one of the cushions 18,20 and extends vertically from the cushions so that the hook end 36 passes over the upper edge of the seat back 14. The hooks 34 are resilient and may be made of suitably resilient plastic or steel and if necessary covered by a suitable covering such as a fabric. The resilient ends 36 cause the hooks to grip the seat back 14 and thereby retain the hooks in position.

The hooks 34 are secured to the cushions 18,20 by hook and loop type fastening indicated at 38. One part of the fastening may be secured by adhesive to the face of the hook 34 and the other sewn or glued to the rear face of the respective cushions 18,20. The fastening 38 permits relative adjustment in a vertical direction between the cushions 18,20 and the hooks so that the height of the lumbar support may be adjusted.

In use, the lateral spacing between the cushions 18,20 is adjusted by separating the straps 28,30 and positioning the cushions 18,20 at the desired spacing. The straps 28,30 are then secured to one another through the fastening 32. The strap 26 is then essentially inextensible so that the separation of the cushions 18,20 laterally outwardly is inhibited.

The cushions 18,20 are then secured to the seat back 14 by the hooks 34. The hooks 34 slip over the back 14 with the resilient hook numbers engaging the back. The spacing of the hooks 34 corresponds to the nominal spacing of the cushions 18,20.

The height of the cushion 18,20 on the chair back 14 may be adjusted by separating the cushion 18,20 from the hooks 34 through the releasable fastening 38 and repositioning the cushions at the desired height.

In this manner, the disposition of the lumbar support 16 can be vertically adjusted to suit individual needs.

It will be noted that the strap 26 is relatively thin and therefore does not force the user forward relative to the seat cushion 12. The original dimensions of the seat 10 are thus maintained but the additional support of the lumbar support 16 is obtained.

While the use of hooks 34 is preferred, alternate retaining devices could be used, such as an elastic strap extending around the seat back 14. The hooks 34 however provide vertical location for the lumbar support and are thus considered to be preferable.

We claim:

1. A lumbar support, for supporting the lumbar region of a seated person, said support having a pair of laterally spaced contoured cushions, a strap extending between said cushions and a retaining device to retain said support on an associated seat back, said strap being adjustable to vary the spacing between said cushions and, when adjusted, inextensible to inhibit relative lateral motion in a direction to increase the spacing between said cushions, wherein each of said cushions have:

top and bottom ends and inner and outer sides;

a convex, outwardly directed surface which comprises a first curve extending between said top and bottom ends;

said first curve having an apex proximate to said bottom end and at approximately ⅓ the overall length of said cushion for supporting the lumbar region in a saggital plane.

2. A lumbar support according to claim 1 wherein said retaining device permits vertical adjustment of said cushions on a seat back.

3. A lumbar support according to claim 2 wherein said retaining device includes a pair of hooks to extend about an edge of said seat back.

4. A lumbar support according to claim 3 wherein said hooks extend from each cushion and are releasably attached to respective ones of said cushions to permit relative movement therebetween.

5. A lumbar support according to claim 4 wherein said hooks are resilient to grip said seat back.

6. A lumbar support according to claim 4 wherein said cushions are releasably attached to said hooks by resilient hook and loop type fasteners.

7. A lumbar support according to claim 1 wherein said strap includes a pair of tongues extending from respective ones of said cushions, said tongues overlapping one another with releasable fastening means extending between said tongues to secure the one to the other.

8. A lumbar support according to claim 7 wherein said releasable fastening means includes resilient hook and loop type fasteners.

9. A lumbar support according to claim 7 wherein each of said contoured cushions is wedge-shaped having a minimum thickness adjacent said tongue.

10. A lumbar support according to claim 1 Wherein said convex, outwardly directed surface further includes a second curve extending between said inner and outer sides; said second curve having an apex at said outer side.

11. A lumbar support, for supporting the lumbar region of a seated person, said support comprising a pair of elongate cushions extending generally parallel to and spaced from one another, a strap extending between said cushions and being adjustable to vary the lateral spacing thereof, a pair of hooks associated with respective ones of said cushions and extending from one end thereof, and releasable fastenings to secure said hooks to respective ones of said cushions, said fastenings permitting relative adjustment between said hooks and said cushions in a longitudinal direction, and wherein each of said cushions have:

top and bottom ends and inner and outer sides;

a convex, outwardly directed surface which comprises a first curve extending between said top and bottom ends;

said first curve having an apex proximate to said bottom end and at approximately ⅓ the overall length of said cushion for supporting the lumbar region in a saggital plane.

12. A lumbar support according to claim 11 wherein said strap includes a pair of tongues having overlapping portions releasably secured to one another to permit adjustment of the spacing between said cushions.

13. A lumbar support according to claim 12 wherein said tongues are secured to one another by resilient hook and loop type fasteners.

14. A lumbar support according to claim 13 wherein said hooks are resilient.

15. A lumbar support according to claim 13 wherein said fastenings are hook and loop type fasteners.

16. A lumbar support according to claim 15 wherein each of said contoured cushions is wedge-shaped having a minimum thickness adjacent said tongue.

17. A lumbar support according to claim 11 wherein said convex, outwardly directed surface further includes a second curve extending between said inner and outer sides; said second curve having an apex at said outer side.

* * * * *

UNITED STATES PATENT AND TRADEMARK OFFICE

CERTIFICATE OF CORRECTION

PATENT NO. : 5,722,725

DATED : March 3, 1998

INVENTOR(S) : McNAUGHTON

It is certified that error appears in the above-identified patent and that said Letters Patent is hereby corrected as shown below:

On the title page, item [73],

Change "Ontario Inc." to --1141864 Ontario Inc.--.

Signed and Sealed this

Twenty-first Day of July, 1998

Bruce Lehman

*Attest:*

BRUCE LEHMAN

*Attesting Officer*

*Commissioner of Patents and Trademarks*